US005732515A

United States Patent [19]

Rodrigues et al.

[11] Patent Number: 5,732,515

[45] Date of Patent: Mar. 31, 1998

[54] CEMETERY MONUMENT

[76] Inventors: Robert Wallace Rodrigues, 325 W. Maple Ave., Bound Brook, N.J. 08805; Wallace Joseph Rodrigues, 300 Jefferson Ave., North Plainfield, N.J. 07060

[21] Appl. No.: 748,561

[22] Filed: Nov. 13, 1996

[51] Int. Cl.[6] ..... E01F 9/011; E04H 13/00

[52] U.S. Cl. ..... 52/103; 52/104; 312/114; 312/138.1; 312/102

[58] Field of Search ..... 52/103, 104; 312/114, 312/138.1, 102

[56] References Cited

U.S. PATENT DOCUMENTS

| | | | |
|---|---|---|---|
| 1,982,432 | 11/1934 | Hull | 52/103 X |
| 3,611,633 | 10/1971 | Shackelford | 47/34 |
| 3,648,422 | 3/1972 | Tate, Jr. | 52/104 |
| 4,304,076 | 12/1981 | Splendora | 52/104 |
| 5,014,472 | 5/1991 | Svensson | 52/103 |
| 5,363,609 | 11/1994 | Hancovsky | 52/103 |
| 5,546,710 | 8/1996 | Barry | 52/104 |

*Primary Examiner*—Carl D. Friedman
*Assistant Examiner*—W. Glenn Edwards

[57] ABSTRACT

A cemetery headstone/monument intended to be anchored upright in or on a foundation includes a carved or hollowed-out portion which functions as a display area. The hollowed portion may extend through the width of the headstone from the front face to the rear face thus creating a display window. The removed front and rear faces of the headstone may be replaced by a flat rigid material, preferably transparent in nature, so as to create a protective enclosure for the display area. A locking mechanism may be provided so as to secure the contents placed within the display area. A second embodiment of the invention provides for a headstone/monument suitably adapted to permit the non-permanent attachment of display devices To the top and side surfaces of the headstone. The display devices are detachably mounted to the headstone through the use of appropriate bolting means anchored into the headstone and by aligning complimentary holes located in the display device with the pre-drilled holes in the headstone. The top horizontal side of the headstone may have sloped edges to promote water runoff. A third embodiment of the invention provides for a headstone/monument wherein the storage and display area is defined by means of the removable assembly of vertical support members detachably mounted to the top surface of the headstone/monument along with a top member detachably mounted to the support members.

2 Claims, 3 Drawing Sheets

AVAILABLE C

CEMETERY MONUMENT

BACKGROUND OF THE INVENTION

This invention relates to headstones/monuments of the type intended to be anchored upright in or on a foundation.

The placement of various items of personalty at gravesites such as flowers, jewelry, photos and other mementos has long existed as a means of "keeping in touch" with the faithfully departed. These items of personalty are usually placed on the ground adjacent to the headstone and as such, create cemetery maintenance problems especially in the area of grass cutting. Additionally, many cemeteries have rules and regulations which prohibit the placement of such items on or about headstones and other grave markers.

SUMMARY OF THE INVENTION

It is apparent from the above that some form of personalty display which could be utilized in conjunction with existing headstones or monuments would be ideal in affording heirs the opportunity to remember the deceased while at the same time overcoming cemetery objections relating to maintenance. In my pending application, Ser. No. 701,022 entitled Monument Display Case and Mounting Assembly I disclose a novel assembly for detachably mounting a display case to the upper portion of a headstone or monument. The present invention permits the display of various items of personalty in connection with headstones/monuments at gravesites by focusing on the headstone/monument itself without the necessity of utilizing an external mounting device. Accordingly, it is an object of the present invention to provide a means for displaying items of personalty in conjunction with a headstone. It is further an object of the present invention to provide such a display area by means of a hollowed or cut-out portion of the headstone itself. It is further an object of the present invention to provide such a display device by internally mounted bolting means. It is also an object of this invention to provide a headstone repository for items of personal property which may be secured by appropriate locking means.

It is yet a further object of this invention to provide a display device which may be adapted to any existing upright headstone or monument.

It is another object of this invention to provide a display device which may be adapted to headstones/monuments of irregular shape and size.

it is yet a further object of this invention to provide a display area adaptable to monuments in alternative settings of commemoration.

BRIEF DESCRIPTION OF THE DRAWINGS

The invention is described in the following in greater detail with reference to the enclosed drawings in which.

DETAILED DESCRIPTION

Figure 1:
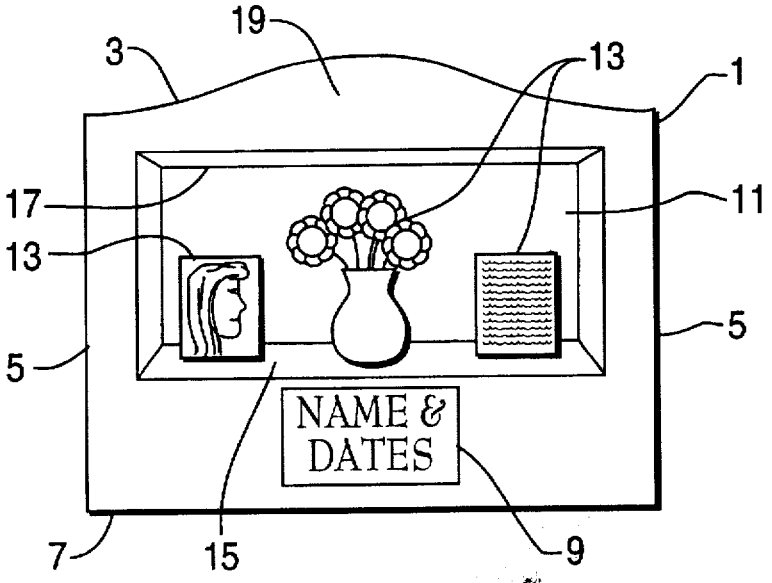
FIG. 1 is a front perspective view of the headstone and display area.
Figure 2:
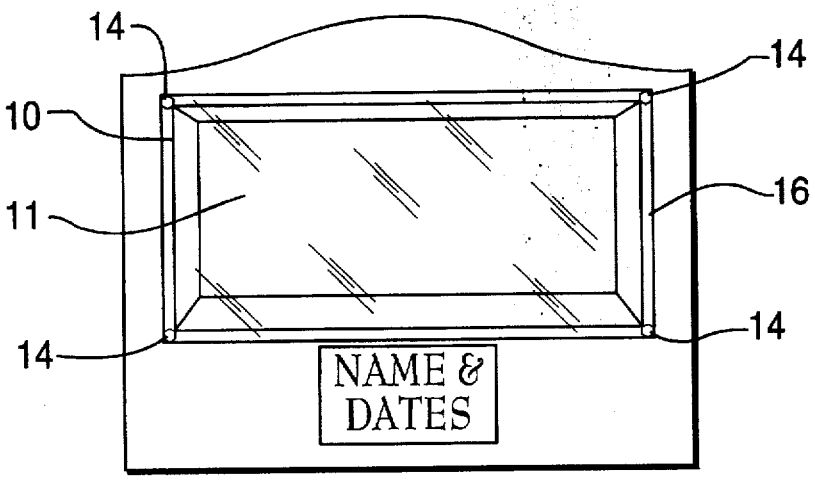
FIG. 2 is a front perspective view of the headstone display area with attached enclosure panel.
Figure 3:
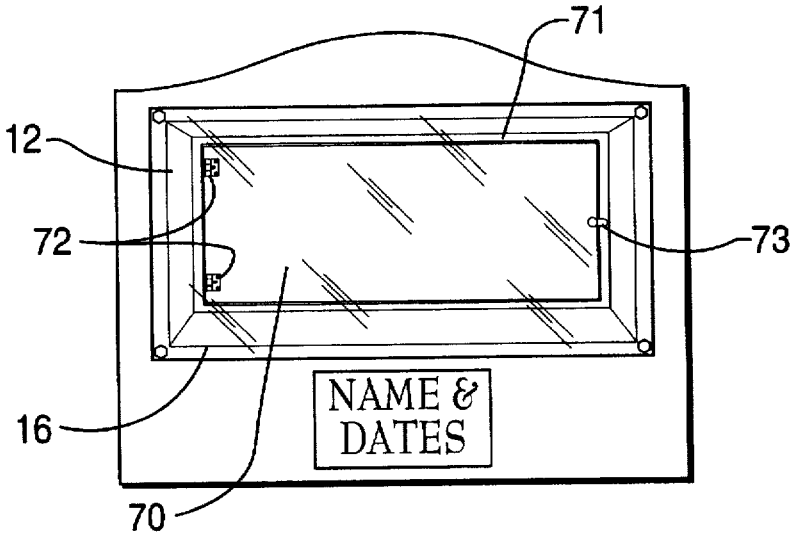
FIG. 3 is a rear perspective view of the headstone and display area with attached enclosure panel.

Referring to FIGS. 1, 2 and 3, one form of the novel cemetery monument of the present invention includes a main body section 1 formed of granite, marble or other type of stone or suitable structural material. Body section 1 includes a front or face panel 19, top panel 3, side panels 5 and a bottom panel 7.

The face panel 19 of body section 1 contains at least one hollowed-out aperture area 11 which extends through the width of the headstone from the front face to the rear face thus creating a window through the center area of the headstone which functions as a repository for various items of display at the grave site.

Hollowed-out portion ii contains flat base member 15 which functions as a shelf or ledge upon which the various items of personalty are placed for display. In addition, hollowed-out area 11 contains top surface 17 from which items of personalty may be suspended by means of appropriate hook means. Display area 9 is provided for text information, such name and date inscriptions to be carved or for some type of decorative placque to be attached.

As can be seen in FIGS. 2 and 3, hollowed out display area 11 may be rendered more secure by means of the attachment of panel members 10, 12, one of which may be transparent to permit viewing of the objects of display.

These enclosure panels 10, 12, may be secured directly to the front and back faces of the headstone by appropriate mounting means 14. Alternatively, securing the panels might involve the installation of a ledge or indentation 16, around the opening of each side of the headstone so as to receive each flat rigid panel thus allowing each panel to be secured in a way such that it would be flush with the external surface of the front or rear face of the headstone.

The mounting means for securing the panels to the front and rear faces of the headstone might include the use of bolts or a bonding agent. As yet another example of securing the front and rear panels, long bolts which pass through the hollowed opening could be used to secure the front and rear panels to each other.

As can be seen in FIG. 3, access to the display area can be achieved through the creation of a door 70 in either the front panel 10 or rear panel 12 by removing or cutting a portion of the panel to receive a molding 71 or door jamb to which a door may be hingedly attached by appropriate hinges 72. Alternatively, the enclosure panels may be hingedly attached directly to the headstone by means of conventional hinge and bolting means or attached to a secured molding or door frame thus allowing each panel to function as a door for gaining access to the enclosure.

An appropriate locking mechanism 73 located on the panels that may function as doors may also be utilized to further secure the display enclosure and prevent removal of display objects contained therein. Additionally, shelf supports may be placed inside the display area to increase the number of display surfaces.

Figure 4:
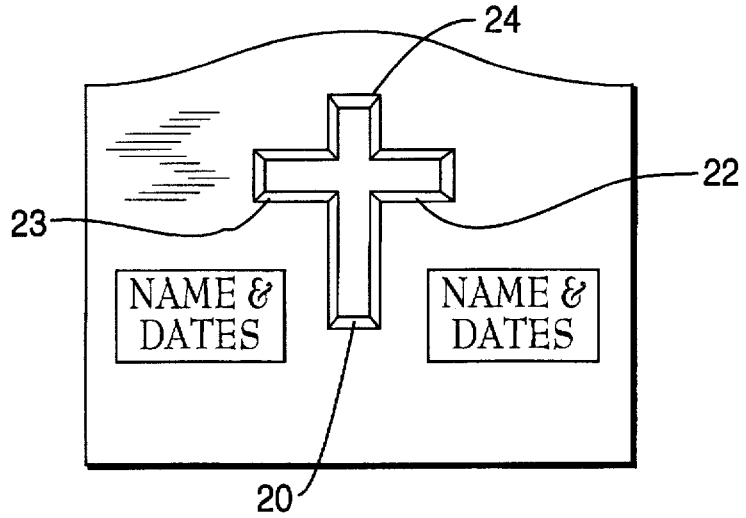
FIG. 4 is a front perspective view of another embodiment of headstone and display area.

As can be seen in FIG. 4, the novel hollowed out display area may take many different shapes such as the depicted cross 24 which contains display surfaces 20, 22 and 23.

The size and shape of the hollowed out display area may further vary depending on the size and shape of the display case desired and the size and shape of the headstone material being used. Additionally, display area 11 may be created by hollowing out less than the full width of headstone 1, thus creating a display area for viewing from one side only.

Figure 5:
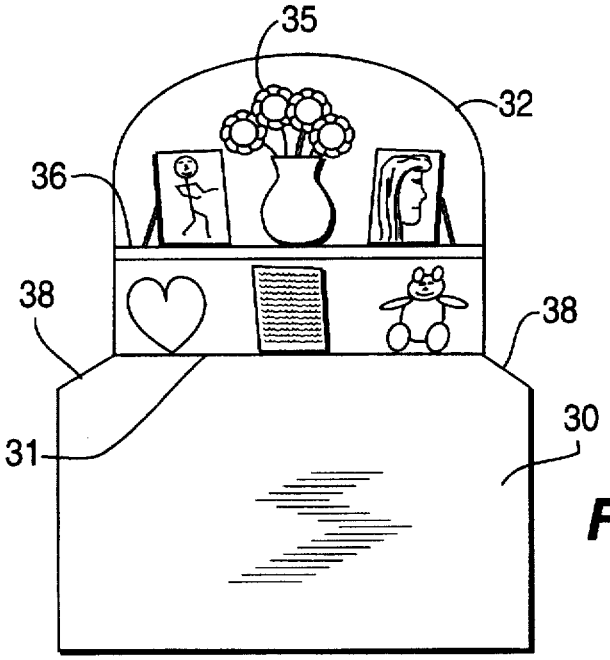
FIG. 5 is a front perspective of the headstone with display case mounted on the top surface thereof.
Figure 7:
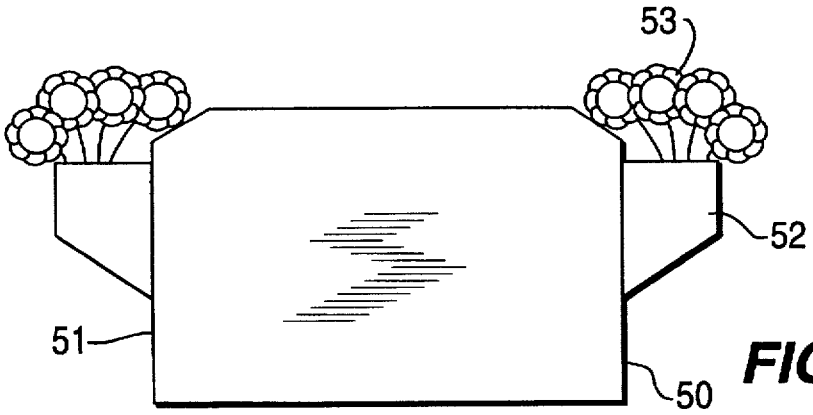
FIG. 7 is a front perspective view of the headstone with side mounted flower holders.
Figure 10:
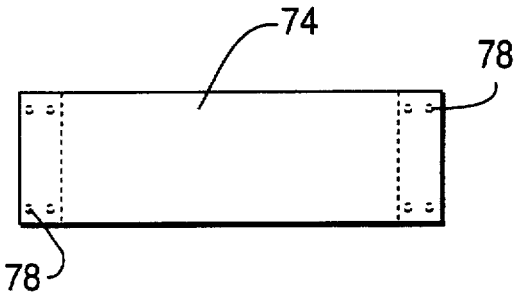
FIG. 10 is a top view of the headstone depicting the mounting means.

A further embodiment of this novel invention is depicted in FIGS. 5 and 7 which provide for detachable display devices extending from the top or side surfaces of the headstone in a tasteful and aesthetic way.

Figure 6:
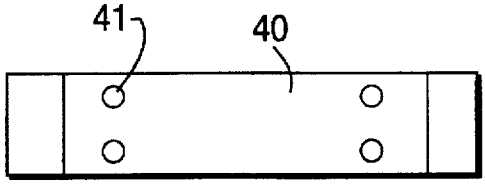
FIG. 6 is a top view of the headstone depicting the mounting means.

Referring to FIG. 5, conventional headstone 30 constructed of conventional granite, marble or other suitable stone or rigid material, provides for display case 32 detachably mounted to top surface 31 by appropriate bolting means as depicted in FIG. 6. Display case 32 may contain a plurality of shelves 36 on which various items of personalty 35 may be displayed. Display case 32 may take many different sizes and shapes depending on the size of complimentary headstone 30.

As shown in FIG. 6, display case 32 is detachably mounted to flat top surface 31 of headstone 30 through appropriate bolting means which may include threaded sleeves, anchors or threaded bolts secured into headstone 40 by means of pre-drilled holes 41. The threaded sleeves, anchors or Dolts may be secured into monument holes 41 by an appropriate bonding agent, or in the case of threaded sleeves or anchors in the pre-drilled holes, these will be used to receive the threaded bolts and may also be secured by the expansion and compression against the walls of the pre-drilled holes.

Display case 32 is detachably mounted to the top surface of headstone 30 by aligning complimentary holes in the bottom surface 33 of display case 32 with anchors, threaded sleeves or threaded bolts set in holes 41 and utilizing either threaded bolts or threaded nuts.

The top horizontal side of headstone 30 may be provided with sloped edges 38 so as to facilitate water run-off from top surface 31 of the headstone.

Figure 8:
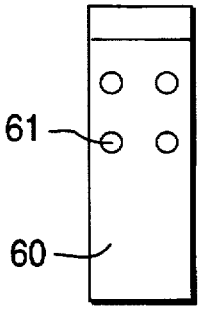
FIG. 8; is a side perspective view of a headstone depicting the mounting means for side display.

A further embodiment of this invention is depicted in FIGS. 7 and 8 which includes plant holders 52 mounted to side surface 51 of headstone 50. As described in connection with the mounting of display case 32 in FIG. 5, appropriate pre-drilled holes 61 are provided to accommodate threaded sleeves, anchors or threaded bolts for means of detachably mounting plant holders 52 to side surface 51 of headstone 50.

Yet a further embodiment of this invention is depicted in FIGS. 9, 10, 11 and 12 which includes the detachable assembly of vertical members 72 and horizontal member 74 to each other and to the top surface of the main body section of headstone 70 thus defining a storage chamber 76. Panel members 72 and 74 may be formed of granite, marble or other type of stone to match the construction of main body section 70 or other suitable structural material. These members may be secured to each other and to the main body section 70 by means of metal pins or bolts anchored into pre-drilled holes 78 coupled with a sealing or bonding agent.

Figure 12:
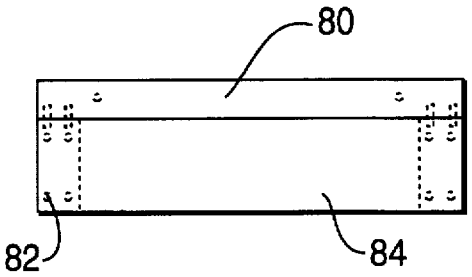
FIG. 12 is a top view of the headstone depicting the mounting means.
Figure 9:
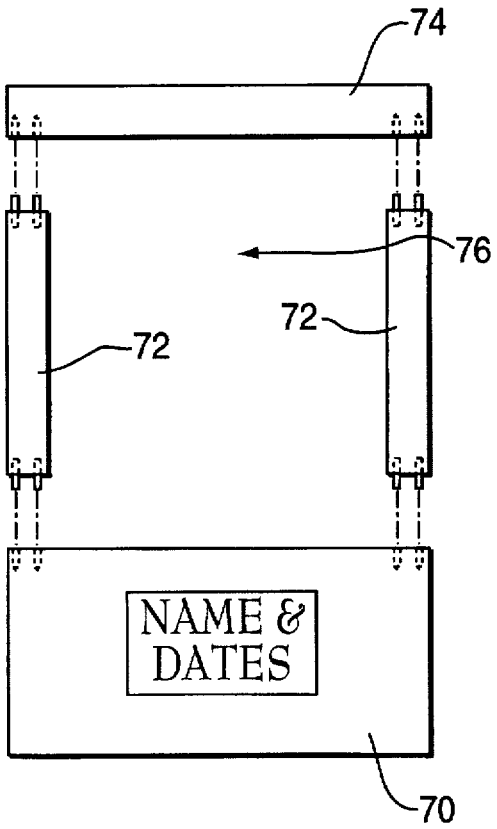
FIG. 9 is a front perspective view of another embodiment of a headstone and display area.
Figure 11:
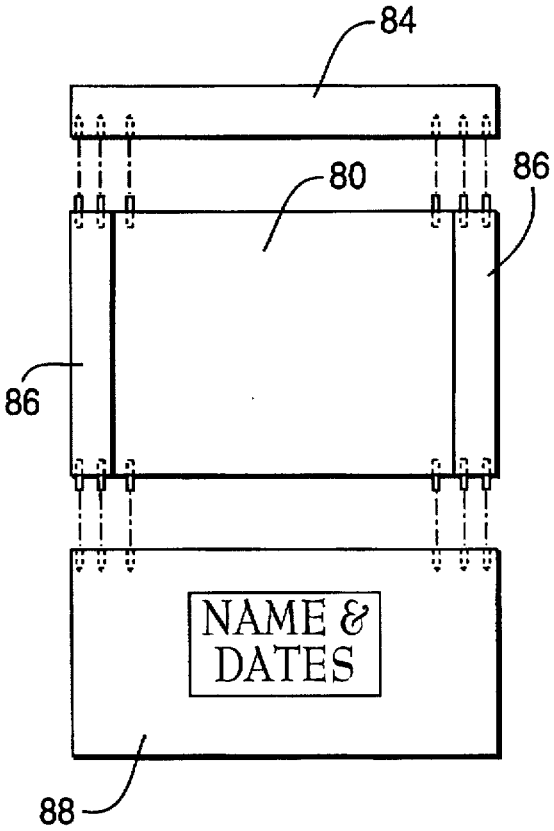
FIG. 11 is a front perspective view of the embodiment shown in FIG. 9 with a rear panel.

As can be seen in FIGS. 11 and 12, a further embodiment involves the detachable assembly of vertical members 86 and horizontal member 84 to each other and to the top surface of the main body section of headstone 88 thus defining a storage chamber. FIGS. 11 and 12 further depict back panel member 80 which may be formed of granite, marble or other suitable structural material thus defining a display area which may be viewed from one side only as compared to the open display area as depicted in FIG. 9 which may be viewed from both sides of the monument. Suitable attachment means such as metal pins or bolts anchored in pre-drilled holes 82 coupled with a sealing or bonding agent may be employed to create the display area as depicted in FIG. 11.

As depicted in FIG. 3, the storage and display chamber 76 of FIGS. 9 and 11 may contain enclosure panels secured to vertical members 72 and 86 by appropriate mounting means with access being achieved through the creation of a door in either the front or rear panel which may be further secured through appropriate locking means. Additionally, shelf supports may be placed inside the display area to increase the number of display surfaces.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalants may be resorted to, falling within the scope of the invention.

I claim:

1. A cemetery monument comprising a granite main body section containing a front and back face surface and two side surface;

a rectangular hollow opening extending from the front face to the back face of said main body section said hollow opening containing flat top and bottom surfaces thus defining a rectangular central storage chamber within said main body section;

one or more display shelves contained within said storage chamber; and a front and a back transparent plastic panel member attached to the front and back face of said headstone for enclosing said central rectangular storage chamber, and means for unlockably locking either of said panels in a closed position.

2. The monument according to claim 1 wherein said locking means comprises a conventional lock and key.

* * * * *